US010625911B1

(12) United States Patent
Laible

(10) Patent No.: US 10,625,911 B1
(45) Date of Patent: Apr. 21, 2020

(54) DUAL DRAW STICK CONTAINER INSERT

(71) Applicant: Rodney Laible, Omaha, NE (US)

(72) Inventor: Rodney Laible, Omaha, NE (US)

( * ) Notice: Subject to any disclaimer, the term of this patent is extended or adjusted under 35 U.S.C. 154(b) by 0 days.

(21) Appl. No.: 16/682,562

(22) Filed: Nov. 13, 2019

(51) Int. Cl.

| | |
|---|---|
| ***B65D 47/12*** | (2006.01) |
| ***B05B 15/30*** | (2018.01) |
| ***B05B 1/14*** | (2006.01) |
| ***B05B 12/00*** | (2018.01) |
| ***B65D 41/04*** | (2006.01) |
| ***B65D 47/32*** | (2006.01) |

(52) U.S. Cl.
CPC ..... *B65D 47/123* (2013.01); *B05B 1/14* (2013.01); *B05B 15/30* (2018.02); *B05B 12/004* (2013.01); *B65D 41/0492* (2013.01); *B65D 47/32* (2013.01)

(58) Field of Classification Search
CPC ..... B65D 47/32; B65D 47/2012; B65D 47/2018; B65D 47/2037; B65D 47/2043; B65D 47/205; B65D 47/24; B65D 47/241; B65D 47/242; B65D 47/26; B65D 47/261; B65D 47/263; B65D 47/266; B65D 47/283; B65D 47/28; B65D 47/123; B05B 15/30; B05B 1/14
See application file for complete search history.

(56) References Cited

U.S. PATENT DOCUMENTS

| | | | | | |
|---|---|---|---|---|---|
| 5,108,015 | A * | 4/1992 | Rauworth | B67D 1/0835 | 137/212 |
| 5,152,437 | A * | 10/1992 | Klein | B67D 7/0272 | 222/400.7 |
| 5,544,810 | A * | 8/1996 | Horvath, Jr. | B05B 7/2443 | 239/10 |
| 6,619,318 | B2 * | 9/2003 | Dalhart | B01F 3/0865 | 137/565.22 |
| 6,669,062 | B1 * | 12/2003 | Laible | B67D 7/0294 | 141/244 |
| 7,407,117 | B2 * | 8/2008 | Dodd | B05B 7/2443 | 222/145.8 |
| 9,458,003 | B1 * | 10/2016 | Laible | B67D 7/0266 | |
| 9,963,279 | B2 * | 5/2018 | Huber | B67D 3/0032 | |
| 2012/0241474 | A1 * | 9/2012 | Dennis | B05B 15/30 | 222/137 |
| 2016/0185494 | A1 * | 6/2016 | Sasturain | B65D 43/0277 | 222/1 |

* cited by examiner

*Primary Examiner* — Patrick M. Buechner
(74) *Attorney, Agent, or Firm* — Dennis L. Thomte; Thomte Patent Law Office LLC

(57) ABSTRACT

A dual draw stick container insert which is designed to dispense liquid chemical from a liquid chemical container. The container insert is configured to have a pair of separate flow channels extending therethrough.

8 Claims, 9 Drawing Sheets

DUAL DRAW STICK CONTAINER INSERT

BACKGROUND OF THE INVENTION

Field of the Invention

This invention relates to a dispensing system for use on a liquid container such as a bottle or the like for dispensing the liquid contents from the bottle. More particularly, this invention relates to a container insert which is press-fitted into the throat of the container and which has a valve positioned therein which is open when the liquid is being dispensed from the container and which is closed to stop the flow of liquid from the container. Even more particularly, this invention relates to a container insert which has dual draw sticks or dip tubes extending downwardly from the container insert into a liquid chemical container thereby providing two separate flow channels from a single chemical container.

Description of the Related Art

Applicant's previously patented container inserts had a single draw stick, sometimes called a dip tube or a pick-up tube which extends downwardly from the insert into a liquid chemical container. Applicant's previous container inserts could only draw chemical from a chemical container by way of a single draw stick. Thus, if a person wished to provide one dilution to fill a bottle or the like and wished to provide another dilution to fill a bucket or the like, the person would have to use two containers having different dilutions therein.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A dual draw stick container insert is disclosed for use with a dispensing system including a container having a throat with an inside surface. The insert includes a horizontally disposed ring-shaped lip having an upper side, a lower side, an outer side and an inner side. A generally cylindrical wall member, having an open upper end, an open lower end, an inner surface and an outer surface, extends downwardly from the inner end of the lip whereby the lip protrudes outwardly from the upper end of the wall member. A generally horizontally disposed first annular shoulder extends inwardly from the inner surface of the cylindrical wall member and which has a plurality of vertically disposed and regularly-spaced vent openings, having upper and lower ends, extending therethrough. An upstanding hollow receiver is positioned within the cylindrical wall member with the receiver having an upper end, a lower end, an inner side and an outer side. The receiver is secured to the inner end of the first annular shoulder so that the upper end of the receiver is positioned above the first annular shoulder and so that the lower end of the receiver is positioned below the first annular shoulder. The receiver includes a horizontally disposed second annular shoulder extending inwardly from the inner side of the receiver with the second annular shoulder having a central opening formed therein.

The invention also includes an upstanding hollow valve stem, having an upper end and a lower end, with the valve stem including an upper tubular member having a bore formed therein and a lower tubular member having a bore formed therein. The upper tubular member has a greater diameter than the lower tubular member. The insert also includes a third annular shoulder, having an upper end and a lower end, which extends outwardly from the valve stem between the upper and lower ends thereof. The valve stem is vertically movably positioned in the receiver between upper and lower positions with respect thereto. The upper end of the third annular shoulder of the valve stem is in engagement with the lower end of the second annular shoulder when the valve stem is in the upper position. The container also includes a disc member including a body portion having an upper side, a lower side and an outer end. The body portion of the disc member is configured to be press-fitted into the open lower end of the cylindrical wall member. The body portion of the disc member has an upstanding cylindrical outer wall, having upper and lower ends, extending upwardly from the upper side thereof at the outer end thereof. The body portion of the disc member also has an upstanding cylindrical inner wall, having upper and lower ends, extending upwardly from the upper side thereof inwardly of the outer wall thereby defining a cavity between the outer cylindrical wall and the inner cylindrical wall. The body portion of the disc member has a plurality of spaced-apart vent openings formed therein which extend downwardly from the cavity between the outer and inner walls of the body portion. The insert also includes a ring-shaped and flat liner having perforations formed therein which prevent liquid from passing therethrough but which permit air to pass therethrough. The flat liner is positioned on the upper ends of the outer and inner walls of the body portion of the disc member. The body portion of the disc member has an opening formed therein inwardly of the inner wall thereof.

The body portion of the disc member has a first hollow draw stick support extending downwardly therefrom with the body portion of the disc member having a hollow tubular valve member extending upwardly therefrom. The hollow tubular valve member has an open lower end and a closed upper end with the lower end of the valve member being in fluid communication with the first hollow draw stick support. The valve member has at least one opening formed therein below the closed upper end thereof. The container also includes an elongated and compressible tubular plastic spring, having an upper end and a lower end, with the lower end of the tubular plastic spring being positioned on the body portion of the disc member and with the upper end of the tubular plastic spring being in engagement with the lower end of the third annular shoulder. The tubular plastic spring yieldably urges the valve stem to its upper closed position.

The body portion of the disc member also has a second hollow draw stick support, having upper and lower ends, extending downwardly therefrom. The upper end of the second hollow draw stick is in fluid communication with the opening in the body portion. An elongated and hollow first draw stick, having an upper end and a lower end, has its upper end secured to the first draw stick support. An elongated and hollow second draw stick, having an upper end and a lower end, has its upper end secured to the second draw stick support. A first metering tip is positioned in the first draw stick and a second metering tip is positioned in the second draw stick.

When the valve member is in the upper closed position, liquid cannot pass from the liquid container to the upper outer end of the container insert. When the valve member is in its lower open position, two independent flow channels are provided. One of the flow channels is in fluid communication with the first draw stick and the second fluid flow passageway is in fluid communication with the second draw stick.

It is therefore a principal object of the invention to provide a dual draw stick container insert which creates two separate distinct flow channels from one chemical container.

A further object of the invention is to provide accurate dilutions at a low flow rate and a high flow rate through the use of two individual metering tips and separated flow channels. A further object of the invention is to provide a container insert wherein the two flow channels are concentric, which eliminates the need for alignment when connecting either a dual draw cap adapter or a dual draw hand-held dispenser.

A further object of the invention is to provide a dual draw container insert which does not have any metal components thereof from assembly which eliminates the chance of a chemical reaction from occurring.

A further object of the invention is to provide a container insert which is completely recyclable since all of the components thereof are comprised of a plastic material.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

FIG. 78 is a sectional view as seen on lines 7A-7A of FIG. 5 wherein the upper end of the valve member is open;

DESCRIPTION OF THE PREFERRED EMBODIMENT

Figure 1:
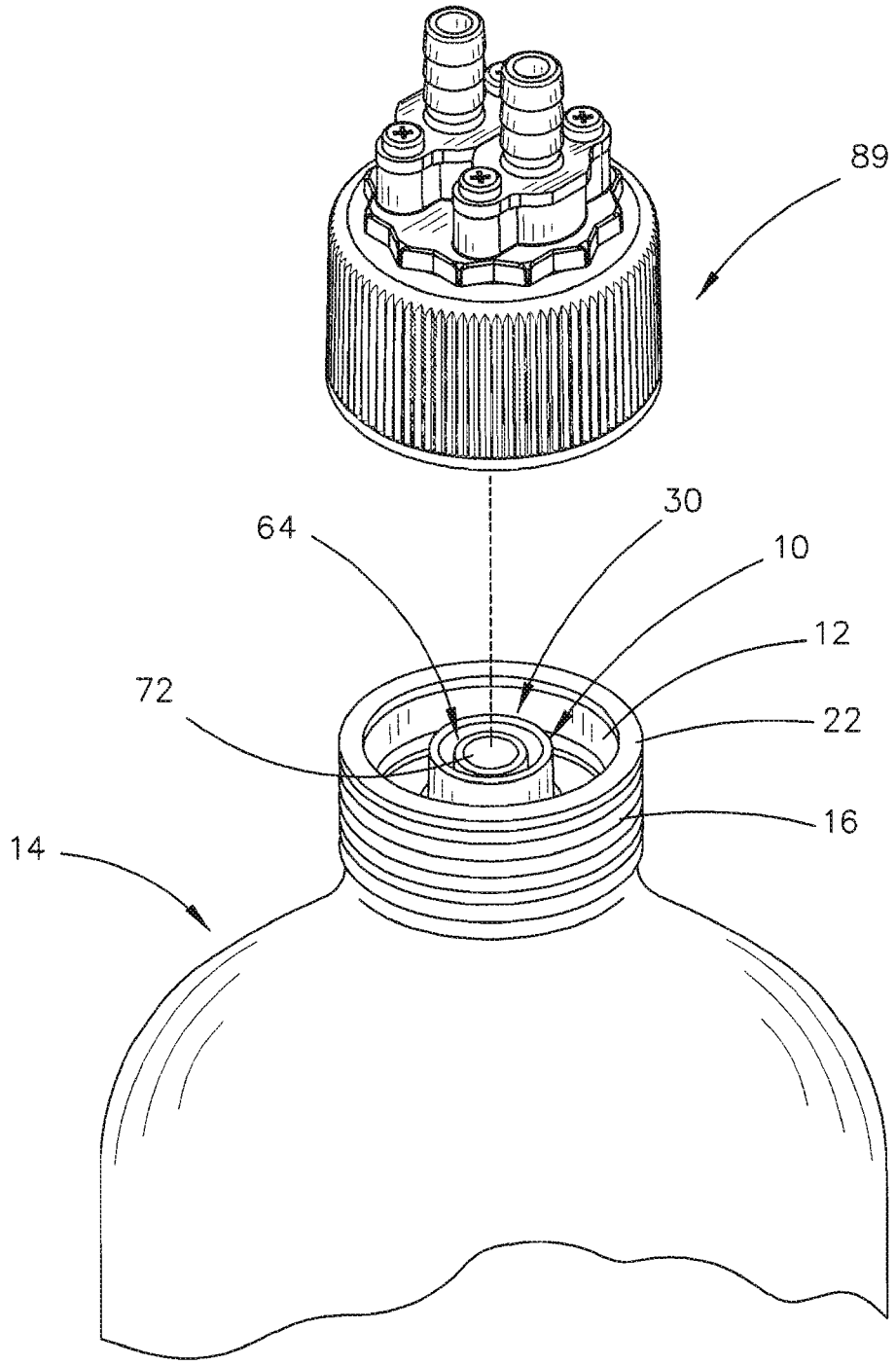
FIG. 1 is a perspective view of a liquid chemical container having the container insert of the invention positioned in the throat of a container.
Figure 2:
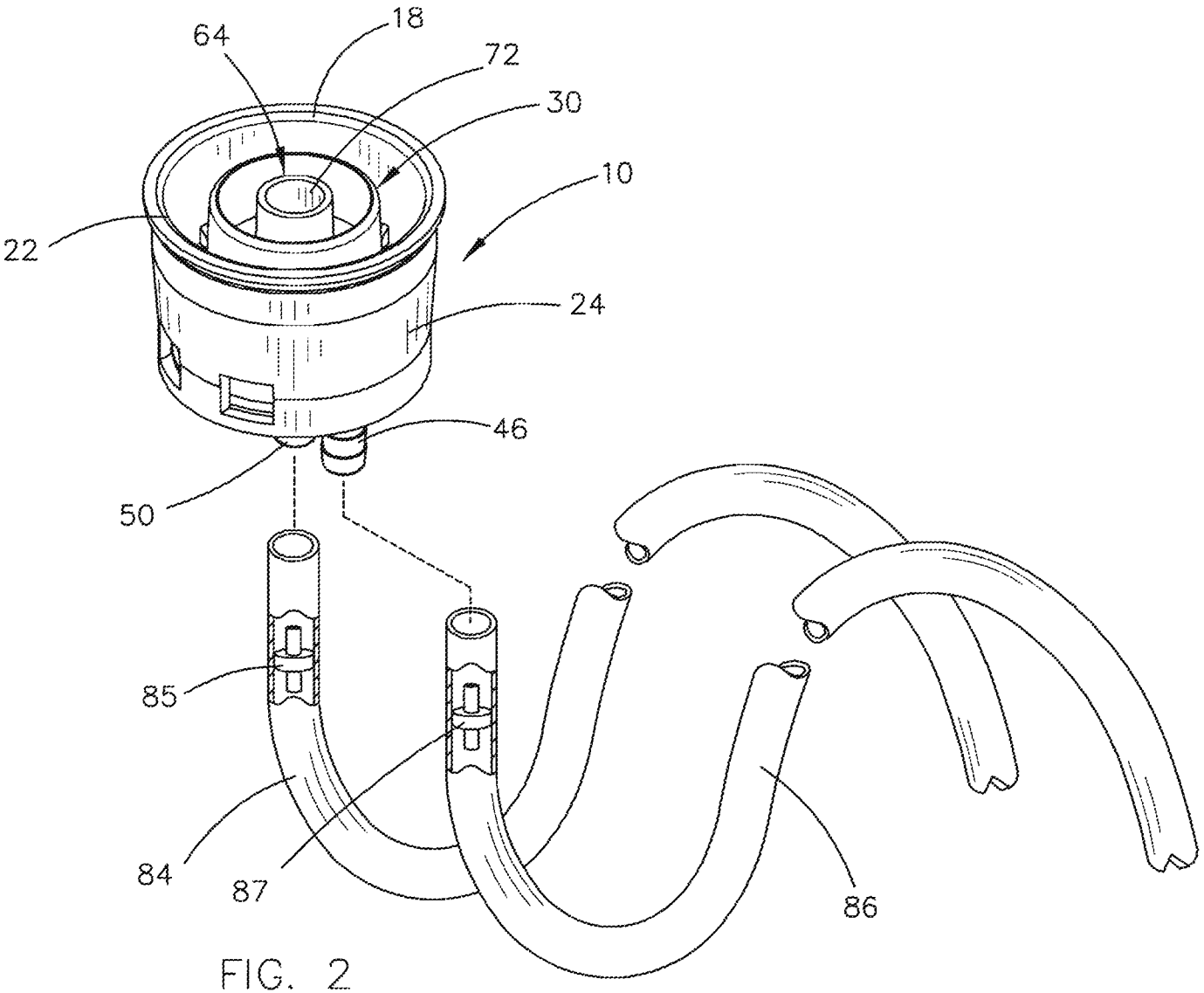
FIG. 2 is an exploded perspective view of the container insert of this invention and the dual draw sticks of this invention.
Figure 3:
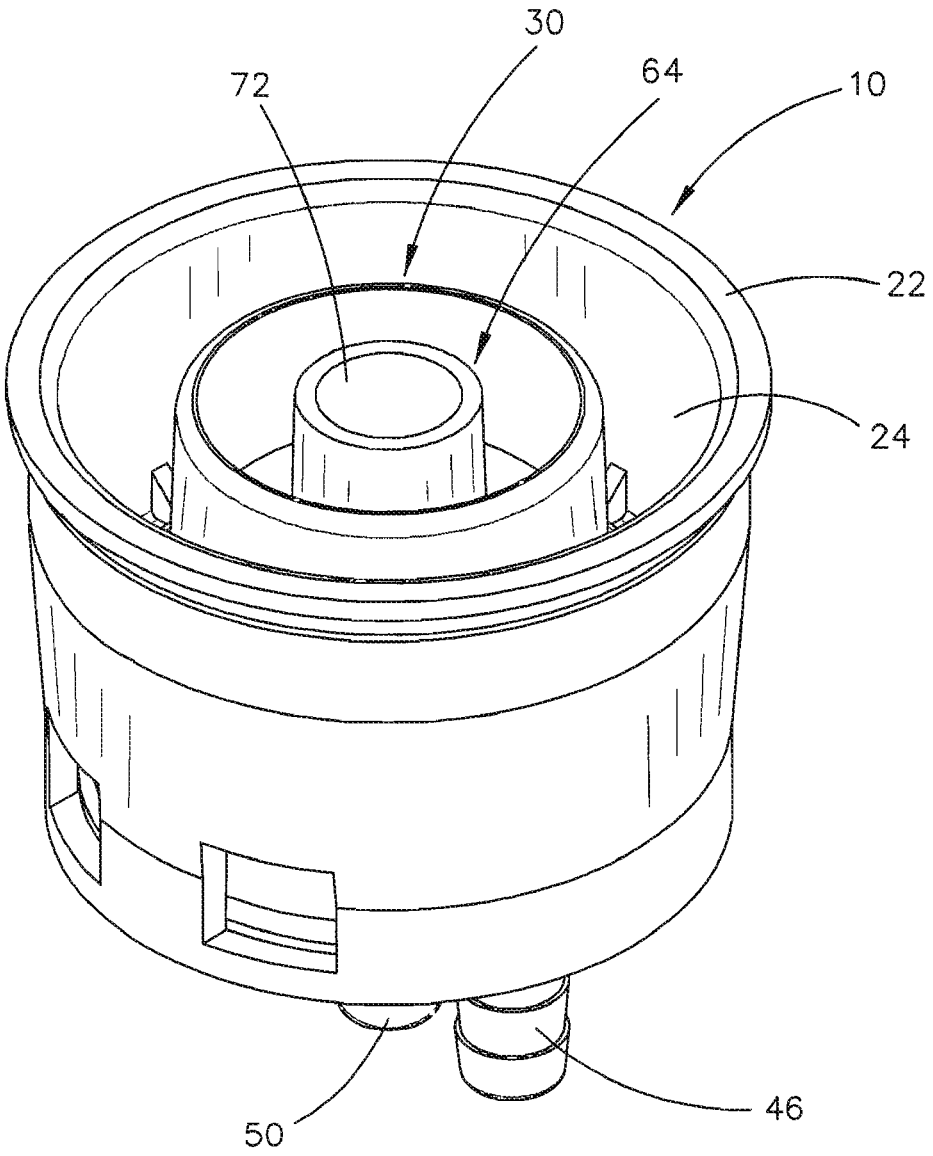
FIG. 3 is an upper perspective view of the container insert of this invention.
Figure 4:
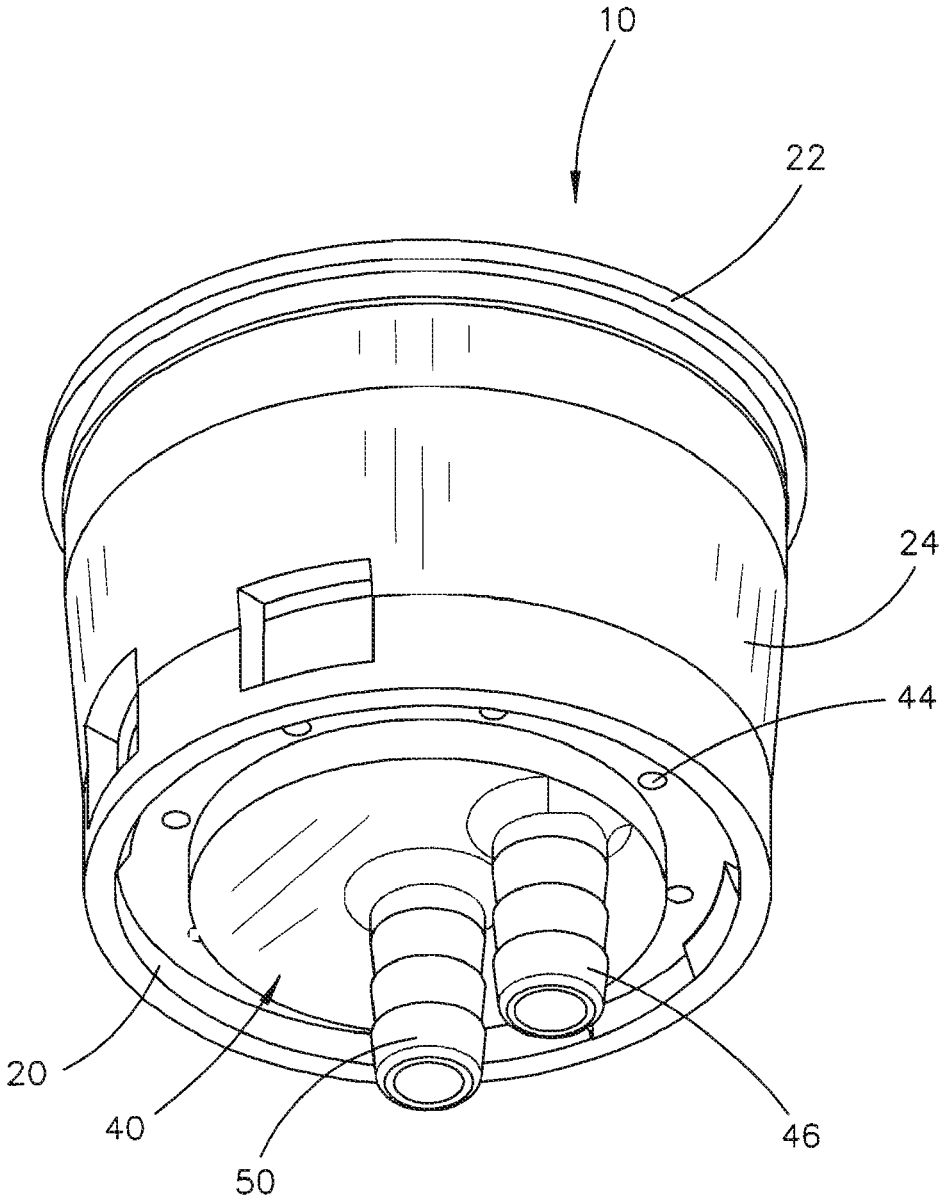
FIG. 4 is a lower perspective view of the container insert of this invention.
Figures 5, 6:
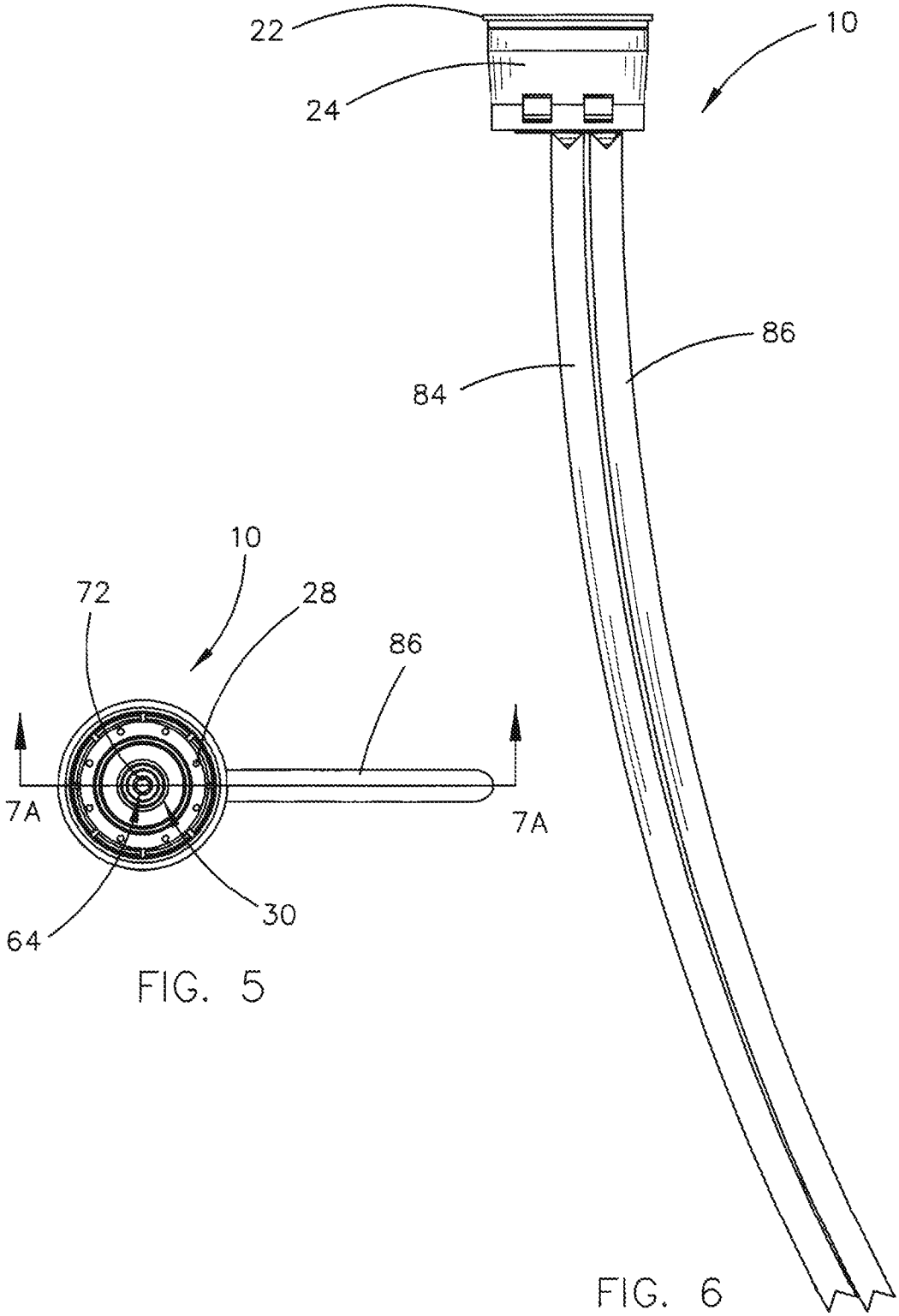
FIG. 5 is a top view of the container insert of this invention.
FIG. 6 is a side view of the container insert of this invention with the dual draw sticks extending downwardly therefrom.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The container insert of this invention is referred to by the reference numeral 10 which is press-fitted into the throat or outlet opening 12 of a container 14 such as a bottle or the like. Preferably, throat 12 includes external threads 16. Insert 10 includes an open upper end 18 and a lower end 20. Insert 10 includes a ring-shaped upper flange or lip 22 and a first cylindrical wall member 24 which extends downwardly from the inner end of lip 22. Wall member 24 has an inwardly extended and horizontally disposed shoulder or ring-shaped wall member 26 which extends inwardly therefrom above the lower end thereof and which has a plurality of radially spaced-apart openings 28 formed therein.

The numeral 30 refers to an upstanding hollow receiver which has an upper end 32 and a lower end 34. Receiver 30 is integrally formed with shoulder 26 with its upper end positioned above shoulder 26 and its lower end position positioned below shoulder 26. As seen, receiver 30 includes a horizontally extending and ring-shaped wall member 36 which extends inwardly from the inner side of receiver 30 below the upper end 32 thereof. Wall member 36 and has a central opening 38 formed therein.

The numeral 40 refers to a disc member or retainer which is configured to be snap-fitted into the lower open end 20 of insert 10. Disc member 40 includes a bottom wall 42 having an opening 44 formed therein. Retainer 40 has a hollow barbed stick support 46 extending downwardly from bottom wall 42. The upper end of support 46 communicates with opening 44 in bottom wall 42.

The numeral 48 refers to an elongated hollow valve body which is integrally formed with disc member 40. The lower end of valve body 48 communicates with a hollow, barbed stick support 50 which extends downwardly from bottom wall 42 as seen in the drawing. The upper end 52 of valve body 48 is closed as seen in the drawings. The side wall of valve body 48, below the upper end thereof, is provided with a pair of openings 54 formed therein to permit the liquid being drawn from the container 14, through stick support 50, to pass through valve body 48 as will be described in detail hereinafter.

As seen, disc member 40 has an outer wall 56 which extends upwardly from the outer end of bottom wall 42. Disc member 40 also has an inner wall 58 which extends upwardly from bottom wall 42 inwardly of wall 56 to form a cavity 60 therebetween. The numeral 61 refers to a ring-shaped perforated liner which is positioned on the upper ends of walls 56 and 58. Bottom wall 42 has a plurality of radially spaced-apart openings 62 formed therein, the upper ends of which communicate with the cavity 60.

Figure 7A:
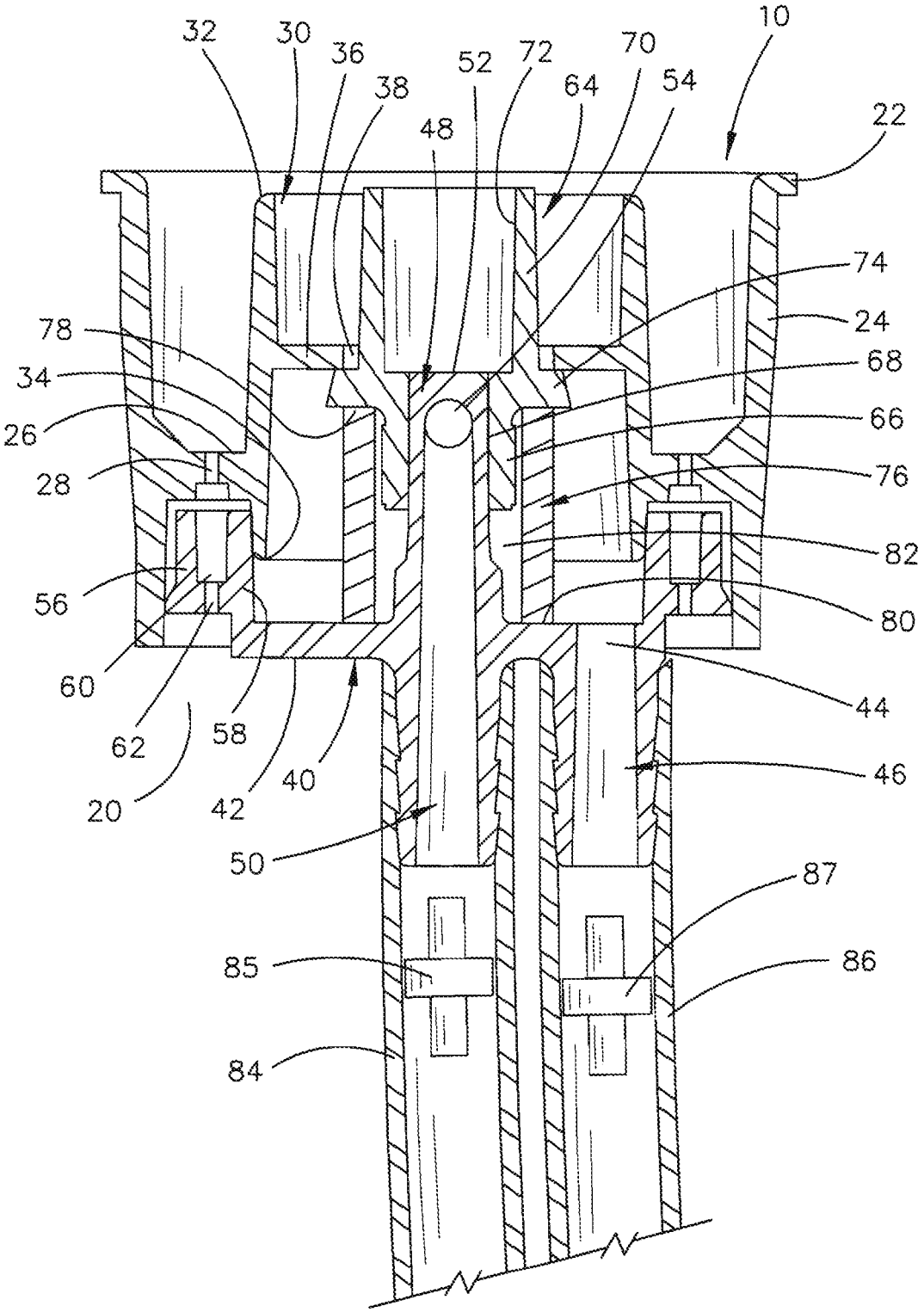
FIG. 7A is a sectional view as seen on lines 7A-7A of FIG. 5 wherein the upper end of the valve member is closed.
Figure 7B:
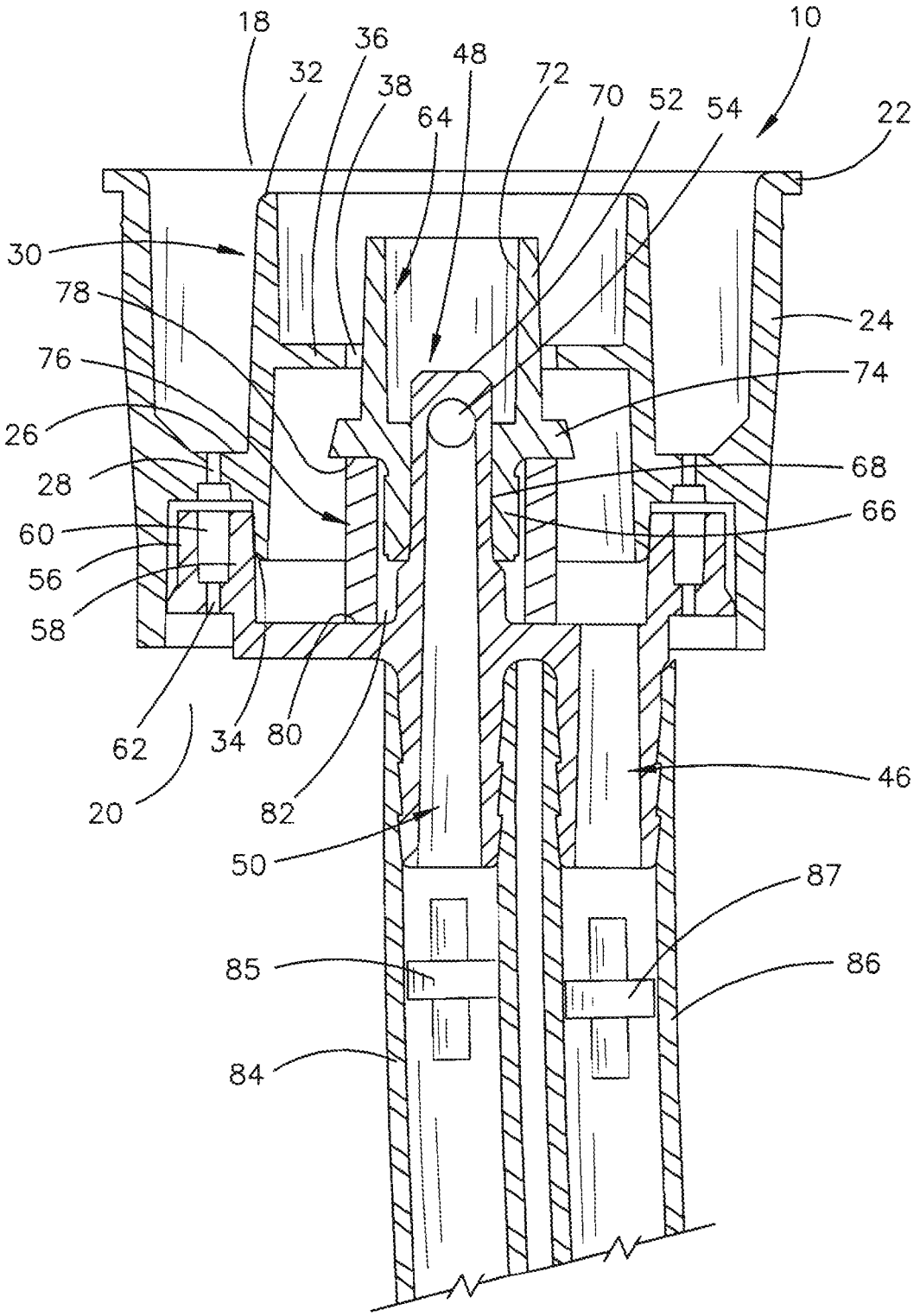
Figure 8:
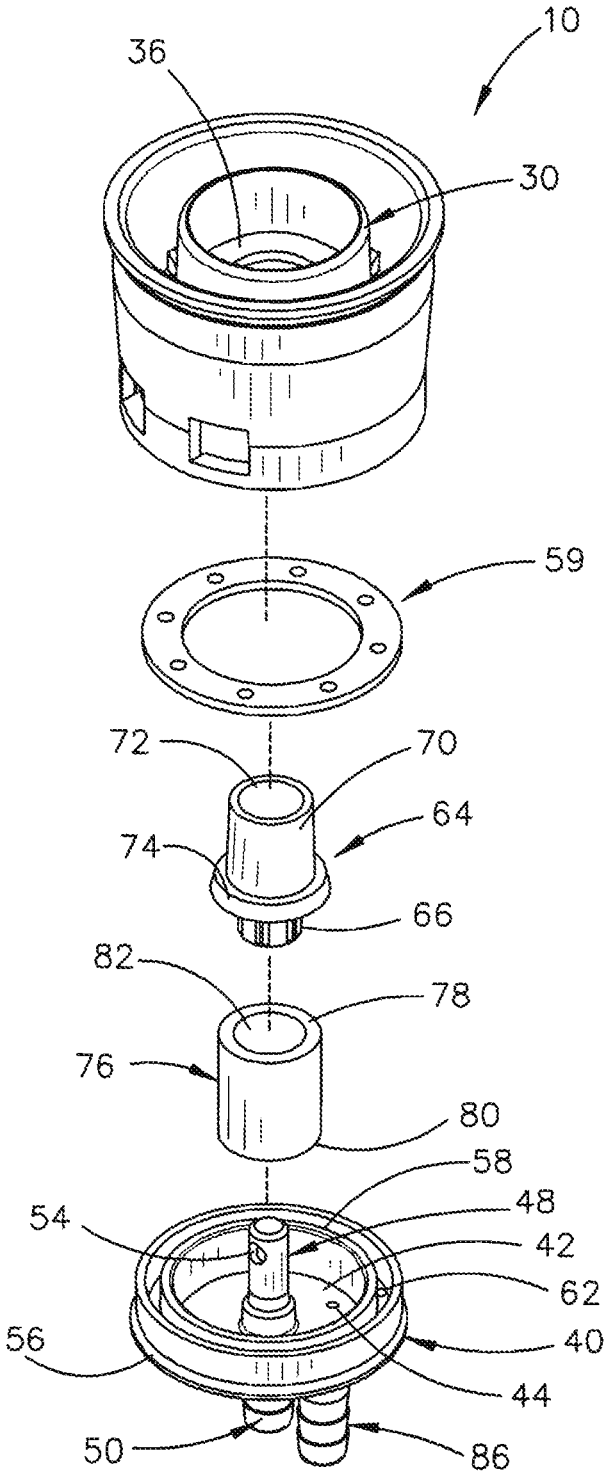
FIG. 8 is an exploded perspective view of the container insert of this invention.
Figure 9:
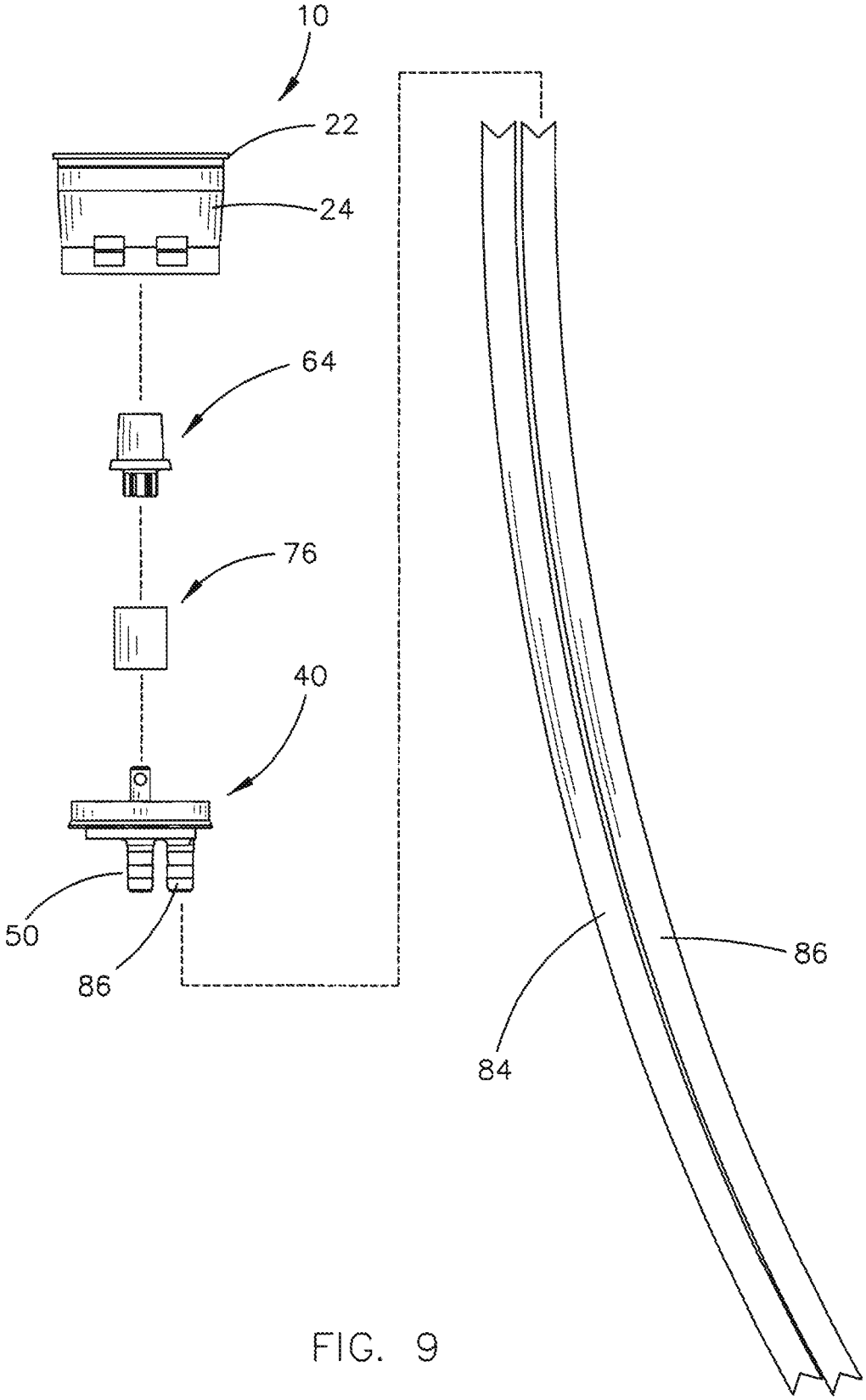
FIG. 9 is an exploded perspective view of the invention.

The numeral 64 refers to a valve stem which is generally cylindrical and which includes a lower cylindrical body portion 66 having a bore 68 formed therein which slidably receives valve body 48. Valve stem 64 also includes an upper tapered and generally cylindrical body portion 70 having a bore 72 formed therein. Bore 72 is larger than bore 68. An annular shoulder 74 extends outwardly from valve stem 64 between body portions 66 and 68. The numeral 76 refers to a plastic, compressible and tubular spring having an upper end 78 and a lower end 80. Bore 82 extends through spring 76. Preferably, spring 74 is comprised of thermoplastic elastomer (TPE) material. As seen, the upper end 78 of spring 76 engages the underside of shoulder 74 with the lower end 80 thereof engaging the upper side of bottom wall 42 of disc member 40 as seen in FIGS. 7A and 7B.

The numeral 84 refers to an elongated and flexible hollow stick. The upper end of stick 84 is mounted on support 50. A metering tip 85 is positioned in stick 84. The numeral 86 refers to an elongated and flexible hollow stick. The upper end of stick 86 is mounted on the support 46. A metering tip 87 is positioned in stock 86. Sticks 84 and 86 are comprised of a suitable plastic material. Normally, the metering tips 85 and 87 will have different metering restrictions.

The design of the container insert 10 provides two separate flow channels through the insert 10. The first flow channel extends upwardly through draw stick 84, through the metering tip 85, upwardly through stick support 50, into the central bore 49 of valve body 48, outwardly through the opening 54 in valve body 48, if valve body 48 is in the open position of FIG. 7B, and outwardly through the interior of valve stem 64. The second flow channel extends upwardly through draw stick 86, through metering tip 87, upwardly through hole or opening 44 in bottom wall 42 of disc member 40, into the interior of disc member 40 inwardly of wall 58, upwardly through the interior of receiver 30 outwardly of spring 76 and the bottom of wall member 36 if valve body 48 is closed. If valve body 48 is open, the second flow channel continues through the opening 38 and outwardly from the interior of receiver 30. The two flow channels are only open when the valve body 48 is in the lower open position. The two flow channels are closed when the valve body 48 is in its upper closed position.

The valve member 48 may be moved to its lower open position by a dispensing cap 89, a wall dispenser, etc.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A dual draw stick container insert comprising:

a horizontally disposed ring-shaped lip having an upper side, a lower side, an outer end, and an inner end;

a cylindrical wall member having an open upper end, an open lower end, an inner surface and an outer surface;

said cylindrical wall member extending downwardly from said inner end of said lip whereby said lip protrudes outwardly from said upper end of said cylindrical wall member;

a horizontally disposed first annular shoulder extending inwardly from said inner surface of said cylindrical wall member;

said first annular shoulder having a plurality of vertically disposed and radially spaced-apart vent openings, having upper end lower ends, extending therethrough;

an upstanding hollow receiver positioned within said cylindrical wall member;

said receiver having an upper end, a lower end, an inner side and an outer side;

said receiver being secured to said inner end of said first annular shoulder so that said upper end of said receiver is positioned above said first annular shoulder and so that said lower end of said receiver is positioned below said first annular shoulder;

said receiver including a horizontally disposed second annular shoulder extending inwardly from said inner side of said receiver;

said second annular shoulder having a central opening formed therein;

an upstanding hollow valve stem having an upper end and a lower end;

said valve stem including an upper tubular member having a bore formed therein and a lower tubular member having a bore formed therein;

said upper tubular member having a greater diameter than said lower tubular member;

a third annular shoulder, having an upper end and a lower end, extending outwardly from said valve stem between said upper and lower ends thereof;

said valve stem being vertically movably positioned in said receiver between upper and lower positions with respect thereto;

said upper end of said third annular shoulder of said valve stem being in engagement with said lower end of said second annular shoulder when said valve stem is in said upper position thereby closing said central opening in said second annular shoulder;

said upper end of third annular shoulder of said valve stem being positioned below said second annular shoulder when said valve stem is in said lower position thereby opening said central opening;

a disc member including a body portion having an upper side, a lower side and an outer end;

said body portion of said disc member being configured to be press-fitted into said open lower end of said cylindrical wall member;

said body portion of said disc member having an upstanding cylindrical outer wall, having upper and lower ends, extending upwardly from said upper side thereof at said outer end thereof;

said body portion of said disc member having an upstanding cylindrical inner wall, having upper and lower ends, extending upwardly from said upper side thereof inwardly of said outer wall thereby defining a cavity between said outer cylindrical wall and said inner cylindrical wall;

said body portion of said disc member having a plurality of spaced-apart vent openings formed therein which extend downwardly from said cavity between said outer and inner walls of said body portion;

a ring-shaped and flat liner having perforations formed therein which prevents liquid from passing therethrough but which permits air to pass therethrough;

said flat liner being positioned on said upper ends of said outer and inner walls of said body portion of said disc member;

said body portion of said disc member having an opening formed therein inwardly of said inner wall thereof;

said body portion of said disc member having a first hollow draw stick support extending downwardly therefrom;

said body portion of said disc member having a hollow tubular valve member extending upwardly therefrom;

said hollow tubular valve member having an open lower end and a closed upper end;

said open lower end of said valve member being in fluid communication with said first hollow draw stick support;

said valve member having at least one opening formed therein below said closed upper end thereof;

an elongated and compressible tubular plastic spring having an upper end and a lower end;

said lower end of said tubular plastic spring being positioned on said body portion of said disc member;

said upper end of said tubular plastic spring being in engagement with said lower end of said third annular shoulder;

said tubular plastic spring yieldably urging said valve stem to its upper position;

said body portion of said disc member having a second hollow draw stick support, having upper and lower ends, extending downwardly therefrom;

said upper end of said second hollow draw stick being in fluid communication with said opening in said body portion;

an elongated and hollow first draw stick having an upper end and a lower end;

said upper end of said first draw stick being secured to said first draw stick support;

an elongated and hollow second draw stick having an upper end and a lower end;

said upper end of said second draw stick being secured to said second draw stick support;

said lower ends of said first and second draw sticks being in communication with a source of liquid chemical;

said valve stem, when in said upper closed position, preventing liquid chemical to be drawn through the dual draw stick container insert; and said valve stem, when in said lower open position, enabling liquid chemical to be drawn through the dual draw stick container insert by way of two separate flow channels.

2. The dual draw stick container insert of claim 1 wherein one of said separate flow channels permits liquid chemical to be drawn upwardly through said first draw stick, upwardly through said first draw stick support; upwardly through said hollow tubular valve member, outwardly through said at least one opening in said tubular valve member, and upwardly through said bore of said upper tubular member of said valve stem and wherein the other separate flow channel permits liquid chemical to be drawn upwardly through said second draw stick, outwardly through said second draw stick support, through said opening formed in said body portion of said disc member, around said spring, around said third annular shoulder, upwardly through said central opening in said second annular shoulder and upwardly through said receiver outwardly of said upper tubular member of said valve stem.

3. The dual draw stick container insert of claim 1 wherein at least one of said first and second draw sticks has a metering tip therein.

4. The dual draw stick container insert of claim 1 wherein a first metering tip is positioned in said first draw stick and wherein a second metering tip is positioned in said second draw stick.

5. The dual draw stick container insert of claim 4 wherein said first and second metering tips have different metering capabilities.

6. A dual draw stick container insert comprising:

a horizontally disposed ring-shaped lip having an upper side, a lower side, an outer end, and an inner end;

a cylindrical wall member having an open upper end, an open lower end, an inner surface and an outer surface;

said cylindrical wall member extending downwardly from said inner end of said lip whereby said lip protrudes outwardly from said upper end of said cylindrical wall member;

a horizontally disposed first annular shoulder extending inwardly from said inner surface of said cylindrical wall member;

said first annular shoulder having a plurality of vertically disposed and radially spaced-apart vent openings, having upper end lower ends, extending therethrough;

an upstanding hollow receiver positioned within said cylindrical wall member;

said receiver having an upper end, a lower end, an inner side and an outer side;

said receiver being secured to said inner end of said first annular shoulder so that said upper end of said receiver is positioned above said first annular shoulder and so that said lower end of said receiver is positioned below said first annular shoulder;

said receiver including a horizontally disposed second annular shoulder extending inwardly from said inner side of said receiver;

said second annular shoulder having a central opening formed therein;

an upstanding hollow valve stem having an upper end and a lower end;

said valve stem including an upper tubular member having a bore formed therein and a lower tubular member having a bore formed therein;

said upper tubular member having a greater diameter than said lower tubular member;

a third annular shoulder, having an upper end and a lower end, extending outwardly from said valve stem between said upper and lower ends thereof;

said valve stem being vertically movably positioned in said receiver between upper and lower positions with respect thereto;

said upper end of said third annular shoulder of said valve stem being in engagement with said lower end of said second annular shoulder when said valve stem is in said upper position thereby closing said central opening in said second annular shoulder;

said upper end of third annular shoulder of said valve stem being positioned below said second annular shoulder when said valve stem is in said lower position thereby opening said central opening;

a disc member including a body portion having an upper side, a lower side and an outer end;

said body portion of said disc member being configured to be press-fitted into said open lower end of said cylindrical wall member;

said body portion of said disc member having an upstanding cylindrical outer wall, having upper and lower ends, extending upwardly from said upper side thereof at said outer end thereof;

said body portion of said disc member having an upstanding cylindrical inner wall, having upper and lower ends, extending upwardly from said upper side thereof inwardly of said outer wall thereby defining a cavity between said outer cylindrical wall and said inner cylindrical wall;

said body portion of said disc member having a plurality of spaced-apart vent openings formed therein which extend downwardly from said cavity between said outer and inner walls of said body portion;

a ring-shaped and flat liner having perforations formed therein which prevents liquid from passing therethrough but which permits air to pass therethrough;

said flat liner being positioned on said upper ends of said outer and inner walls of said body portion of said disc member;

said body portion of said disc member having an opening formed therein inwardly of said inner wall thereof;

said body portion of said disc member having a first hollow draw stick support extending downwardly therefrom;

said body portion of said disc member having a hollow tubular valve member extending upwardly therefrom;

said hollow tubular valve member having an open lower end and a closed upper end;

said open lower end of said valve member being in fluid communication with said first hollow draw stick support;

said valve member having at least one opening formed therein below said closed upper end thereof;

an elongated spring having an upper end and a lower end;

said lower end of said spring being positioned on said body portion of said disc member;

said upper end of said spring being in engagement with said lower end of said third annular shoulder;

said spring yieldably urging said valve stem to its upper position;

said body portion of said disc member having a second hollow draw stick support, having upper and lower ends, extending downwardly therefrom;

said upper end of said second hollow draw stick being in fluid communication with said opening in said body portion;

an elongated and hollow first draw stick having an upper end and a lower end;

said upper end of said first draw stick being secured to said first draw stick support;

an elongated and hollow second draw stick having an upper end and a lower end;

said upper end of said second draw stick being secured to said second draw stick support;

said lower ends of said first and second draw sticks being in communication with a source of liquid chemical;

said valve stem, when in said upper closed position, preventing liquid chemical to be drawn through the dual draw stick container insert; and said valve stem, when in said lower open position, enabling liquid chemical to be drawn through the dual draw stick container insert by way of two separate flow channels.

7. The dual draw stick container insert of claim 6 wherein one of said separate flow channels permits liquid chemical to be drawn upwardly through said first draw stick, upwardly through said first draw stick support; upwardly through said hollow tubular valve member, outwardly through said at least one opening in said tubular valve member, and upwardly through said bore of said upper tubular member of said valve stem and wherein the other separate flow channel permits liquid chemical to be drawn upwardly through said second draw stick, outwardly through said second draw stick support, through said opening formed in said body portion of said disc member, past said spring, around said third annular shoulder, upwardly through said central opening in said second annular shoulder and upwardly through said receiver outwardly of said upper tubular member of said valve stem.

8. The dual draw stick container insert of claim 6 wherein a first metering tip is positioned in said first draw stick and wherein a second metering tip is positioned in said second draw stick.

* * * * *